United States Patent [19]

Kashiwazaki

[11] 4,064,859

[45] Dec. 27, 1977

[54] SEMICONDUCTOR IGNITION SYSTEM

[75] Inventor: Seiichi Kashiwazaki, Naka, Japan

[73] Assignee: Hitachi, Ltd., Japan

[21] Appl. No.: 650,766

[22] Filed: Jan. 20, 1976

[30] Foreign Application Priority Data

Jan. 20, 1975 Japan ..... 50-7746

[51] Int. Cl.[2] ..... F02P 9/00; F02P 7/06; F02P 5/08

[52] U.S. Cl. ..... 123/148 E; 123/148 F

[58] Field of Search ..... 123/148 EC, 148 CD, 123/148 E, 148 R, 148 F

[56] References Cited

U.S. PATENT DOCUMENTS 3,741,185 6/1973 Swift et al. ..... 123/148 CC 3,937,193 2/1976 Kim ..... 123/148 E

*Primary Examiner*—Samuel W. Engle

*Assistant Examiner*—Thomas H. Webb

*Attorney, Agent, or Firm*—Craig & Antonelli

[57] ABSTRACT

A semiconductor ignition system having a pick-up device for producing a.c. signals according to the speed of an engine, an ignition coil with a primary and secondary winding, a detecting device for detecting the output of the pick-up device, a switching device for controlling current flow to the primary winding in accordance with the output of the detecting device, and a control arrangement responsive to the output of the pick-up device for controlling the detecting device so that sufficient current flows to the ignition coil during high speed operation of the engine.

12 Claims, 5 Drawing Figures

SEMICONDUCTOR IGNITION SYSTEM

BACKGROUND OF THE INVENTION

The present invention is related to a contactless ignition device employing semiconductors, and particularly to a semiconductor ignition device in which sufficient primary current is fed to the ignition coil during high-speed revolution of an engine.

With the earlier semiconductor ignition systems, the period in which the primary current flows in the ignition coil was subject to change greatly depending upon low-speed revolution, especially idling of the engine and high-speed revolution of the engine. Therefore, at low-speed revolution of the engine in which the period of flowing current to an ignition coil is longer, greater currents were dissipated resulting in the development of heat, and also giving increased load to a battery. Conversely, at high-speed revolution of the engine in which the period of flowing current to a primary winding of an ignition coil is shorter, the cut-off current of the primary current tended to become small, failing to produce sufficient secondary voltage.

To solve such a problem, it was so far attempted to make constant the time of flowing the primary current of the ignition coil by using a particular circuit, such as a monostable multivibrator. However, semi-conductor ignition systems, in general, are based on a principle in which the primary current is flown to the ignition coil to produce a high voltage when the primary current is cut off. The time of producing a high voltage, i.e., the time of cutting off the primary current of the ignition coil is determined by the operating condition of the engine. Therefore, to appropriately control the period of flowing the primary current, it is necessary to control the time at which the primary current starts to flow, thereby requiring a means of accurately controlling the triggering timing of a monovibrator. As a result, it is difficult to accomplish such operation and to expensive to manufacture.

Summary of the Invention

The primary object of the present invention is to provide a semiconductor ignition system which produces a sufficient primary current for the ignition coil during high-speeds of the engine.

Another object of the present invention is to provide a semi-conductor ignition system which can accurately control the time of starting the flow of primary current to the ignition coil using a simple circuit.

Further objects and advantages of the present invention will become apparent from the following description.

The present invention is concerned with a semiconductor ignition system in which a-c signals from the pick-up means developed responsive to the revolution of the engine are detected at a determined level, and the time of starting and cutting off the primary current to the ignition coil are controlled responsive to the output of the detecting means to produce a high voltage, characterized by the provision of charging-discharging circuit having time constant which varies depending upon the polarity of the a-c outputs of the pick-up means, thereby giving a biasing to said detecting means in order that the timing of flowing the primary current to the ignition coil will be advanced during high-speed running of the engine.

Figure 1:
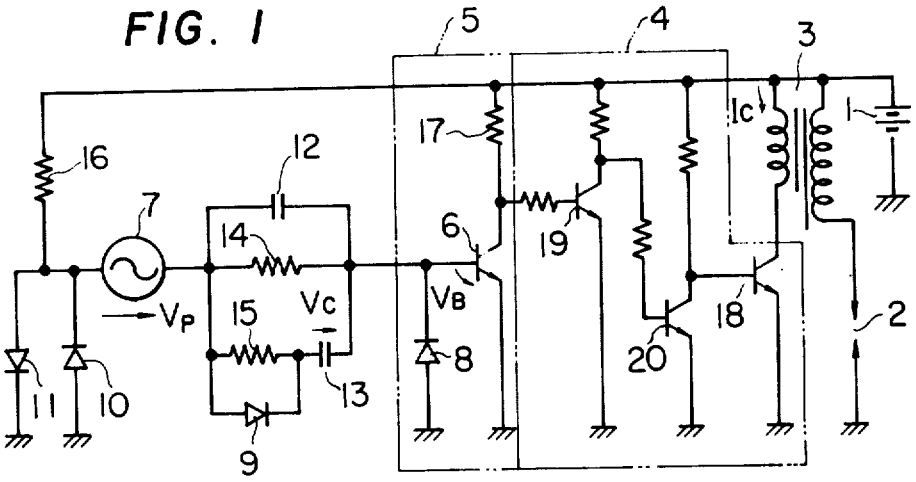
FIG. 1 is a diagram of electric connection showing an embodiment of the semiconductor ignition system according to the present invention.

The invention is illustrated below with reference to an embodiment shown in FIG. 1, in which the reference numeral 1 stands for a storage battery, 2 represents a spark plug, 3 is an ignition coil, and 4 stands for a switching amplifier which interrupts the current $I_c$ to the ignition coil. The reference numeral 5 represents a switching circuit which rectifies the waveforms of a-c voltage Vp generated by an a-c generator or a pick-up coil 7 which revolves in synchronizm with the engine, and in which the a-c voltage Vp from the pick-up coil 7 is applied to the base of a transistor 6 via a parallel circuit composed of a resistor 14 and a capacitor 12. Between the base and emitter of the transistor 6 is a diode 8 which by-passes a current during the negative polarity of a-c voltage Vp of the pick-up coil 7. A series circuit composed of a resistor 15 and a capacitor 13 is provided in parallel with the resistor 14, and a diode 9 is provided in parallel with the resistor 15. A parallel circuit of diodes 10, 11 and a resistor 16 are connected in series across the terminals of the battery 1, and the point at which the resistor 16 and diodes are connected is connected to the pick-up coil 7.

The aforesaid switching amplifier 4 includes a power transistor 18 which is connected in series with the primary coil of the ignition coil 3 as well as switching transistors 19 and 20.

Next, operation of the system is illustrated below with reference to FIGS. 1 and 2. Now, when the output from the pick-up coil 7 is zero (at a crank angle $\theta_3$ in FIG. 2(*a*)), there will flow a current from the battery 1 through resistor 16 and diode 11. Here, the voltage drop of the diode 11 in the forward direction has been set to be greater than the voltage drop across the base and emitter of the transistor 6; therefore, the current from the resistor 16 also flows to the base of the transistor 6 via the pick-up coil 7 and the resistor 14, rendering the transistor 6 to be conductive (ON). Under this condition, the switching amplifier 4 works to cut off the primary current to the ignition coil 3. That is, the transistor 19 is rendered to be OFF, the transistor 20 0N and the power transistor 18 to be OFF. Next, as the output of the pick-up coil 7 becomes negative as shown in the diagram (a) of FIG. 2, the base of the transistor 6 is reversely biased, rendering the transistor 6 to be OFF, transistor 19 to be ON, transistor 20 to be OFF, and power transistor 18 to be ON, so that the primary current flows to the ignition coil 3.

It is assumed that operation of the resistor 15, diode 9 and capacitor 13 is negligible, the primary current continues to flow to the primary coil of the ignition coil 3 from the time at which the engine crank angle $\theta_3$ is passed a little until the engine crank angle $\theta_4$ is passed a little, during which the electromagnetic energy is stored in the primary coil.

Then as the crank angle $\theta_4$ is passed, the output of the pick-up coil 7 is changed from negative to positive, causing the current to flow again to the base of the transistor 6. Then, the transistor 6 is rendered to be ON, the transistor 19 to be OFF, the transistor 20 to be ON, and the power transistor 18 to be OFF, whereby the primary current $I_c$ to the ignition coil 3 is interrupted, inducing high voltage on the secondary coil and giving rise to the occurence of spark at the spark plug 2.

Functions of the capacitor 13, resistor 15 and diode 9 are illustrated below. The output voltage Vp of the pick-up coil 7 is small during low-speed running of the engine as shown by a solid line in the diagram (a) of FIG. 2, and becomes larger at high-speed running as shown by dotted line. Now when the engine is running at low speeds, the a-c voltage Vp produced is small, and small current flows to charge the capacitor 13 through the doide 9. Therefore, the charging is very small in which the output of the pick-up coil 7 is positive during the crank angle $\theta_0 - \theta_4$ of the engine. Therefore, at the time at which the crank angle is $\theta_3$, the terminal voltage $V_c$ of the capacitor 13 can be regarded almost zero. Change of the terminal voltage $V_c$ of the capacitor 13, is shown by the diagram (b) of FIG. 2. When the engine is running at low speeds, there is little effect by the capacitor 13, and the transistor 6 operates nearly in a manner as mentioned above.

In other words, if the output of the pick-up coil 7 is lowered down to negative, the base potential $V_B$ of the transistor 6 as shown by the diagram (c) of FIG. 2 and further lowers down to below the voltage $V_O$. The transistor 6 is then rendered to be OFF. Under this condition, the base voltage $V_B$ continues to increase until the operation voltage $V_O$ is exceeded. During this period, the primary current continues to flow into the ignition coil 3. This state is shown in the diagram (d) of FIG. 2. The primary current flows to the ignition coil during the period of angle $\theta_1$.

Figure 2:
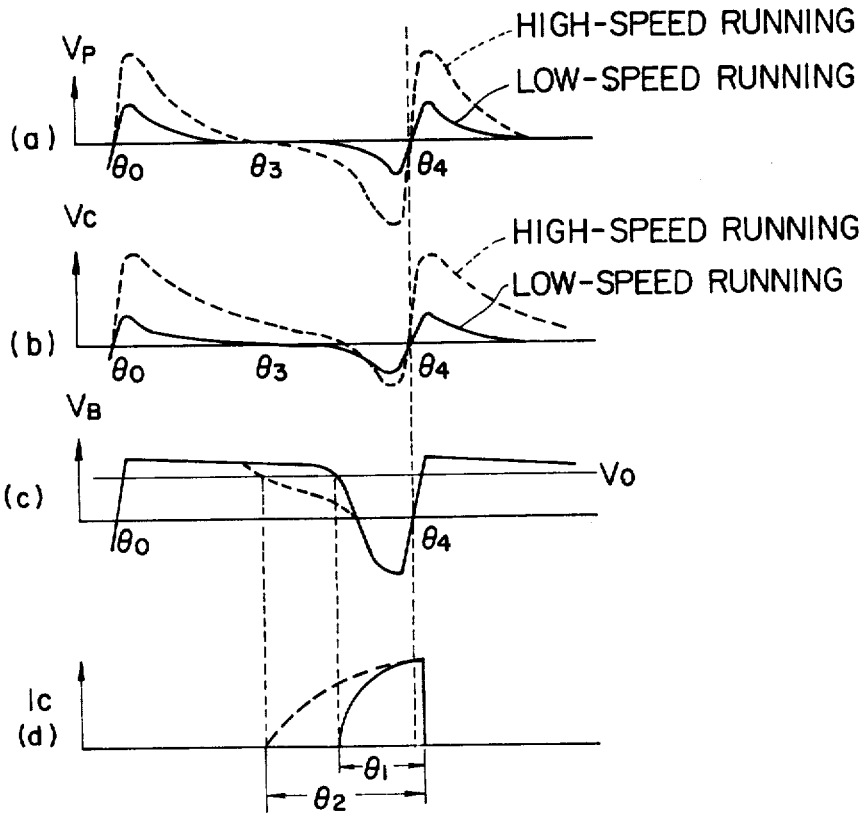
FIG. 2 is a diagram to illustrate the principle of operation of the system of FIG. 1.
Figure 3:
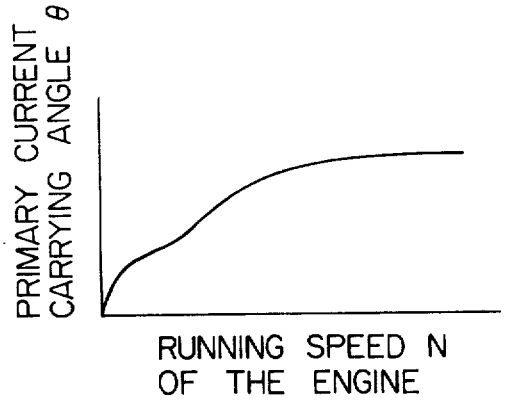
FIG. 3 shows a relation between the ignition coil current angles and the revolution speeds of the engine using the semiconductor ignition system of the present invention.

When the engine is running at high speeds, the output voltage Vp of the pick-up coil 7 is large as shown by a dotted line in the diagram (a) of FIG. 2, so that the voltage $V_C$ charging the capacitor 13 will be large. While the generated voltage Vp is positive, the capacitor 13 is charged via the diode 9, and while the voltage Vp of the pick-up coil 7 is negative, the capacitor 13 is reversely charged (discharged) via the resistor 15. Charging or discharging of the capacitor 13 is determined depending upon whether the voltage Vp of the pick-up coil 7 is positive or negative. Hence, when the engine is running at high speeds, the terminal voltage $V_C$ of the capacitor when the voltage Vp of the pick-up coil is positive, is larger by several times than that when the voltage Vp of the pick-up coil 7 is negative. Accordingly, the voltage $V_B$ across the base and emitter of the transistor 6 is forcibly lowered down by the voltage $V_C$ of the capacitor 13 which is charged by the positive voltage Vp of the pick-up coil 7, and assumes a curve as shown by a broken line of the diagram (c) of FIG. 2. The current-carrying angle of the ignition coil current $I_C$ then becomes $\theta_2$, which is larger than the angle $\theta_1$ at low-speed running of the engine, making it possible to control the current-carrying angle of the ignition coil. Referring to FIG. 3, the abscissa represents running speed N of the engine, and the ordinate represents a primary current-carrying angle $\theta$ of the ignition coil, in which the current-carrying angle increases with the rise of the running speed N of the engine.

Figure 4:
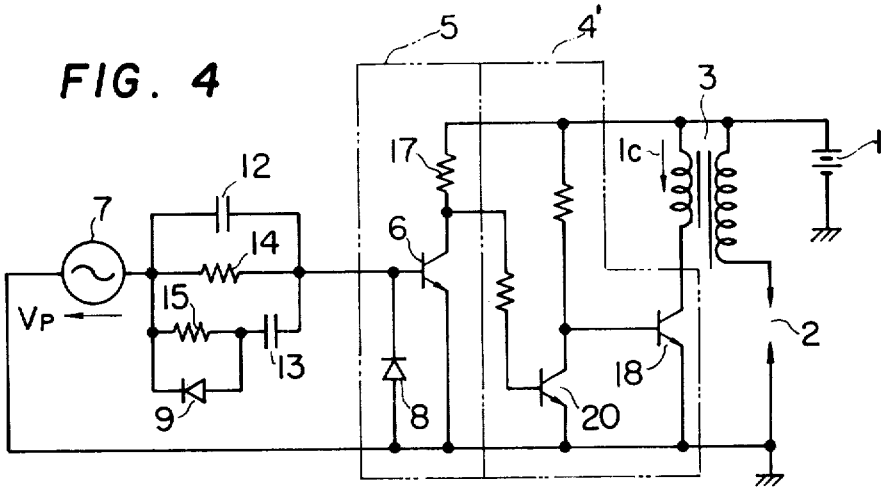
FIG. 4 is a diagram of electric connection showing another embodiment of the semiconductor ignition system according to the present invention.

FIG. 4 shows another embodiment of the present invention, in which the reference numerals represent the same parts as those of FIG. 1. In this embodiment, the switching amplifier 4 is so constructed that the current flows to the ignition coil when the transistor 6 is conductive. The a-c voltage of the pick-up coil 7 is an inversion of the phase of waveforms of FIG. 2, in which the voltage is developed in the positive direction during the angles $\theta_3$ to $\theta_4$. The capacitor 13 which produces a voltage toward the negative direction after the angle $\theta_4$ is strongly charged by the negative voltage via the diode 9.

Being so constructed, if the running speed of the engine rises, the capacitor 13 will have higher charge by the negative voltage than the voltage by the positive voltage. Therefore, the voltage across the base and emitter of the transistor 6 is kept to be higher than the operation voltage, so that the transistor 6, i.e., the ignition coil will have extended periods of carrying current, making it possible to control the current-carrying period of the ignition coil.

As will be understood from the foregoing description, according to the system of the present invention, great difference is given to the charging and reversely charging current responsive to the polarities of the pick-up voltage $Vp$ of the capacitor 13 to control the operation of the transistor 6, for the purpose of changing the primary current-carrying angle of the ignition coil 3; the current-carrying angle increases with the increase of the output $Vp$ of the generator 7.

Figure 5:
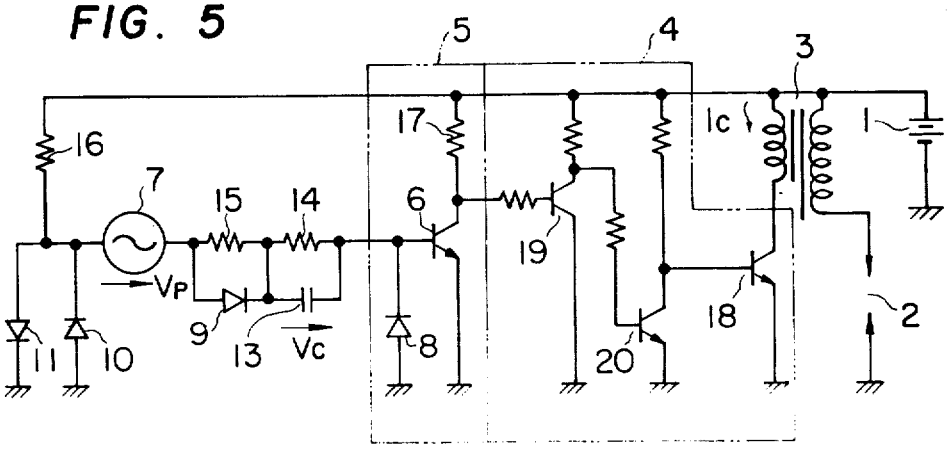
FIG. 5 is a schematic diagram of a further embodiment of the semiconductor ignition system according to the present invention.

Therefore, the embodiment may also assume the setup shown in FIG. 5. Parts represented by the same numberals as those of FIG. 1 perform the same functions. When the output $Vp$ of the pick-up coil 7 is positive, the capacitor 13 is charged via the diode 9. On the other hand, when the output $Vp$ of the pick-up coil 7 is negative, the capacitor 13 is reversely charged through the resistor 15. Therefore, the charging current will be greater when the output $Vp$ of the pick-up coil 7 is positive than when the output $Vp$ is negative, giving difference to the terminal voltage of the capacitor 13 depending upon the polarities of a-c signals. And the difference increases with the increase of the output $Vp$ of the pick-up coil 7. Other elements function in the same manner as the embodiment of FIG. 1.

As mentioned above, the semiconductor ignition system according to the present invention enables to obtain appropriate current-carrying time for the ignition coil responsive to the running speed of the engine, minimizing the current that will be consumed at low-speed running of the engine, minimizing the development of heat, producing sufficient secondary voltage at high-speed running of the engine, and preventing misparking that may be caused by insufficient secondary voltage.

The simple circuit according to the present ivention makes it possible to control the current-carrying period for the ignition coil, and can be manufactured cheaply requiring less circuit elements.

What is claimed is:

1. A semiconductor ignition system comprising:

an ignition coil having a primary winding and a secondary winding;

spark plugs;

a first connection means to connect the secondary coil of said ignition coil to said spark plugs;

a first transistor having emitter, collector and base electrodes;

a second connection means which connects the emitter and collector electrodes of said first transistor to the primary coil of the ignition coil and to a d-c current supply means in series;

a pick-up coil which generates a-c signals in synchronism with the revolution of the engine;

a second transistor which detects the output of said pick-up coil; and a switching means which supplies current to the base of said first transistor responsive to the output of said second transistor, for the purpose that the primary current of the ignition coil is controlled responsive to the output of said pick-up coil so that a high voltage which will be fed to said spark plugs is generated on the secondary winding;

the improvement characterized by a parallel circuit of a resistor and a diode, a capacitor connected in series with the parallel circuit and means for connecting said series circuit of said parallel circuit and said capacitor to said pick-up coil and the base of said second transistor.

2. A semiconductor ignition system comprising:

an ignition coil having a primary winding and secondary winding;

spark plugs;

a first connection means to connect the secondary coil of said ignition coil to said spark plugs;

a first transistor having emitter, collector and base electrodes;

a second connection means which connects the emitter and collector electrodes of said first transistor to the primary winding of the ignition coil and to a d-c current supply means in series;

a pick-up coil which generates a-c signals in synchronism with the revolution of the engine;

a second transistor which detects the output of said pick-up coil; and a switching means which supplies current to the base of said first transistor responsive to the output of said second transistor, for the purpose that the primary current of the ignition coil is controlled responsive to the output of said pick-up coil so that a high voltage which will be fed to said spark plugs is generated on the secondary coil;

the improvement characterized in that the semiconductor ignition control system further comprises a parallel circuit of a resistor and a diode, a capacitor, a series circuit comprising the parallel circuit, the capacitor and one connecting means for connecting the parallel circuit and the capacitor in series; and another connecting means for connecting the one and other terminals of the pick-up coil, the series circuit, and the base and the emitter electrodes of the second transistor in a closed loop.

3. A semiconductor ignition system according to claim 1 wherein a second resistor is provided in parallel with said capacitor.

4. A semiconductor ignition system according to claim 1 wherein a second resistor is further provided in parallel with said series circuit composed of said parallel circuit, and said capacitor.

5. A semiconductor ignition system comprising:

ignition coil means having a primary winding and a secondary winding;

spark plug means;

first connection means for connecting the secondary coil of said ignition coil means to said spark plug means;

a first transistor having emitter, collector and base electrodes;

second connection means for connecting the emitter and collector electrodes of said first transistor to the primary coil of the ignition coil means and to a d-c current supply means in series;

pick-up means for generating a-c signals in synchronism with the revolution of the engine;

a second transistor for detecting the output of said pick-up means;

switching means for supplying current to the base of said first transistor in response to the output of said second transistor for controlling the primary current of the ignition coil in accordance with the output of said pick-up means so that a high voltage is generated on the secondary winding for feeding to said spark plug means; and control means responsive to the output of said pick-up means for controlling the conduction of said second transistor whereby sufficient primary current is fed to the ignition coil means during high speed operation of the engine, the control means including a parallel circuit comprising a first resistor and a diode, a capacitor connected in series to said parallel circuit, and third connection means for connecting said series circuit of said parallel circuit and said capacitor to said pick-up means and the base of said second transistor.

6. A semiconductor ignition system according to claim 5, wherein said control means further comprises a second resistor connected in parallel with said capacitor.

7. A semiconductor ignition system according to claim 5, wherein said control means further comprises a second resistor connected in parallel with a series circuit comprising said parallel circuit of said first resistor and diode, and said capacitor.

8. A semiconductor ignition system comprising:

ignition coil means having a primary winding and a secondary winding;

spark plug means;

first connection means for connecting the secondary coil of said ignition coil means to said spark plug means;

a first transistor having emitter, collector and base electrodes;

second connection means for connecting the emitter and collector electrodes of said first transistor to the primary coil of the ignition coil means and to a d-c current supply means in series;

pick-up means for generating a-c signals in synchronism with the revolution of the engine;

a second transistor for detecting the output of said pick-up means;

switching means for supplying current to the base of said first transistor in response to the output of said second transistor for controlling the primary current of the ignition coil in accordance with the output of said pick-up means so that a high voltage is generated on the secondary winding for feeding to said spark plug means; and control means repsonsive to the output of said pick-up means for controlling the conduction of said second transistor whereby sufficient primary current is fed to the ignition coil means during high speed operation of the engine, said control means including a parallel circuit comprising a resistor and a diode, a capacitor connected in series with said parallel circuit and third connection means for connecting said parallel circuit, said capacitor, said pick-up means and the base and emitter electrodes of said second transistor so as to establish a closed loop.

9. In a semiconductor ignition system having a pick-up means for producing a-c signals in accordance with the speed of an engine, ignition coil means having a primary and secondary winding, detecting means for detecting the output of the pick-up means and providing an output in accordance therewith, and switching means for controlling current flow to the primary winding in accordance with the output of the detecting means so as to generate a high voltage in the secondary winding of the ignition coil means, the improvement comprising control means responsive to the output of said pick-up means for controlling said detecting means so that sufficient current flows to the ignition coil means during high speed operation of the engine, said control means including circuit means having a time constant which varies in dependence upon the polarity of the a-c signals from said pick-up means, said current means being a charging-discharging circuit means for controlling the detecting means during high speed operation of the engine, said charging-discharging circuit means including a parallel circuit comprising a first resistor and a diode, and a capacitor connected to said parallel circuit, and further comprising means for connecting said parallel circuit and said capacitor to said pick-up means and said detecting means.

10. A semiconductor ignition system according to claim 9, wherein said charging-discharging circuit means further comprises a second resistor connected in parallel with said capacitor.

11. A semiconductor ignition system according to claim 9, wherein said charging-discharging circuit means further comprises a second resistor connected in parallel with a series circuit comprising said parallel circuit of said first resistor and diode, and said capacitor.

12. In a semiconductor ignition system having a pick-up means for producing a-c signals in accordance with the speed of an engine, ignition coil means having a primary and secondary winding, detecting means for detecting the ouput of the pick-up means and providing an output in accordance therewith, and switching means for controlling current flow to the primary winding in accordance with the output of the detecting means so as to generate a high voltage in the secondary winding of the ignition coil means, the improvement comprising control means responsive to the output of said pick-up means for controlling said detecting means so that sufficient current flows to the ignition coil means during high speed operation of the engine, said control means including circuit means having a time constant which varies in dependence upon the polarity of the a-c signals from said pick-up means, said circuit means being a charging-discharging circuit means for controlling the detecting means during high speed operation of the engine, said charging-discharging circuit means including a parallel circuit comprising a resistor and a diode, and a capacitor connected in series with said parallel circuit, and means for connecting said parallel circuit and said capacitor to said pick-up means and said detecting means so as to establish a closed loop.

* * * * *